US006234577B1

(12) United States Patent
Ruppert et al.

(10) Patent No.: US 6,234,577 B1
(45) Date of Patent: May 22, 2001

(54) CHAIR

(75) Inventors: Kerry E. Ruppert, Fort Lauderdale; Joann J. Festa, Davie, both of FL (US)

(73) Assignee: Joke, Inc., Davie, FL (US)

( * ) Notice: Subject to any disclaimer, the term of this patent is extended or adjusted under 35 U.S.C. 154(b) by 0 days.

(21) Appl. No.: 09/567,304

(22) Filed: May 8, 2000

(51) Int. Cl.[7] ..... A47C 7/02
(52) U.S. Cl. ..... 297/452.17
(58) Field of Search ..... 297/452.48, 452.41, 297/452.37, 452.17; 5/654, 655.5, 909

(56) References Cited

U.S. PATENT DOCUMENTS

D. 355,306 2/1995 Moses ..... D6/333
3,584,914 * 6/1971 Williams .
3,899,210 * 8/1975 Samhammer et al. .
4,027,888 6/1977 Wilcox ..... 297/284
4,370,769 * 2/1983 Herzig et al. .
4,514,010 * 4/1985 Gonzlez .
4,838,613 * 6/1989 Smith .
5,195,199 * 3/1993 Sereboff .
5,733,012 * 3/1998 Jones .
5,941,599 8/1999 Roberts ..... 297/115
6,024,407 * 2/2000 Eakin .

* cited by examiner

*Primary Examiner*—Milton Nelson, Jr.
(74) *Attorney, Agent, or Firm*—Gunster, Yoakley & Stewart, P.A.

(57) ABSTRACT

A chair includes a flexible enclosure having a first compartment and a second compartment. A freely-flowable filler material is disposed within the first compartment and the second compartment. The filler material can have a different material density and/or distribution density in each compartment.

2 Claims, 1 Drawing Sheet

CHAIR

CROSS-REFERENCE TO RELATED APPLICATIONS

Not applicable.

STATEMENT REGARDING FEDERALLY SPONSORED RESEARCH

Not applicable.

FIELD OF THE INVENTION

This invention relates to chairs and more particularly, to a flexible-resilient chair.

BACKGROUND OF THE INVENTION

Chairs are ancient art and take countless forms. A dictionary defines a chair as "a piece of furniture for one person to sit on, having a back and, usually, four legs." While a chair need not have legs, it generally provides back support, unlike a stool. The "beanbag" chair, popularized in the 1960's, is an example of such a chair.

Typically, a beanbag chair includes sheets of inexpensive, colorful, flexible material sewn together to provide a generally spherical enclosure for a quantity of inexpensive, loose filling, such as polystyrene beads (the "beans"). The enclosure is usually only filled with beads to about half its capacity, thereby giving the enclosure an amorphous, shape. When a person sits on the beanbag chair, a depression readily forms and the person is seated in the depression. Although the resultant body position may be comfortable, it can also be awkward, especially for an adult. These chairs are, however, inexpensive to acquire and they are perceived as "fun" to sit on, especially by children.

In an attempt to retain the comfort of the beanbag chair, but to improve upon its versatility, additional support and shape-holding elements have been added to the flexible enclosure. For example plastic and metal frames that are configured like traditional chair seats and backs have been enclosed within a flexible enclosure. The result is a traditional chair with padding that is easily displaced from the frame. Thus, such a chair does not provide the benefits of either a traditional chair or a beanbag chair. Worse yet, the possibility for injury is greatly increased as people tend to jump or "plop" onto beanbag chairs, whereas traditional chairs are usually mounted with a certain level of reserve. Therefore, if one jumps onto a beanbag chair having hidden, rigid elements, there is an increased likelihood of injury.

It would therefore be desirable to provide a chair that has the comfort of a beanbag, with the additional support provided by frame elements, but without the potential danger of rigid elements.

SUMMARY OF THE INVENTION

The present invention provides a variable contour chair that is self-supporting and safe. In an exemplary embodiment, a chair includes a flexible enclosure having a first compartment and a second compartment. A freely-flowable filler material is disposed within the first compartment and the second compartment. The filler material can have a different material density and/or distribution density in each compartment.

In an exemplary embodiment, a seat portion of the chair includes the first compartment and a backrest portion of the chair includes the second compartment, and the second compartment is provided with a higher material and/or distribution density of filler material than the first compartment.

BRIEF DESCRIPTION OF THE DRAWINGS

A more complete understanding of the present invention , and the attendant advantages and features thereof, will be more readily understood by reference to the following detailed description when considered in conjunction with the accompanying drawings, wherein.

DETAILED DESCRIPTION OF THE INVENTION

Figure 1:
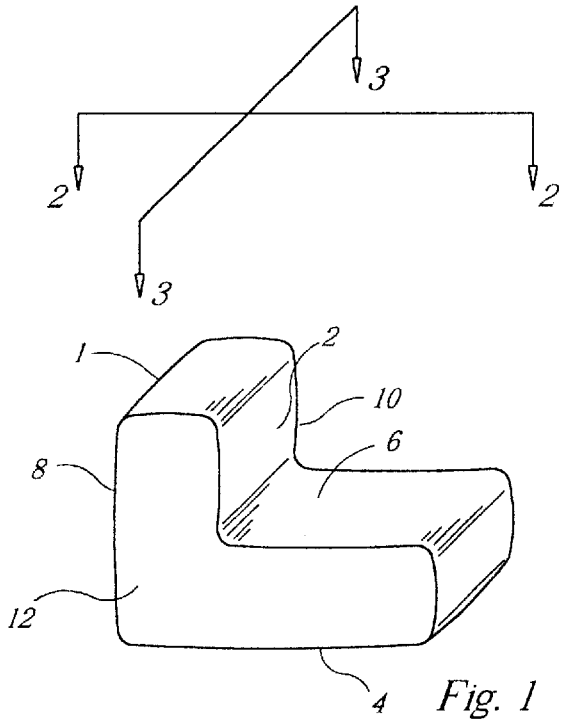
FIG. 1 is a perspective view of a chair in accordance with the invention.

FIG. 1 is a perspective view of a chair in accordance with the invention. The chair has a flexible enclosure 1 which defines the general shape of the chair. The chair has a top portion 2 which is opposite a bottom portion 4; a front portion 6 which is opposite a back portion 8; and a left portion 10 which is opposite a right portion 12.

Figure 2:
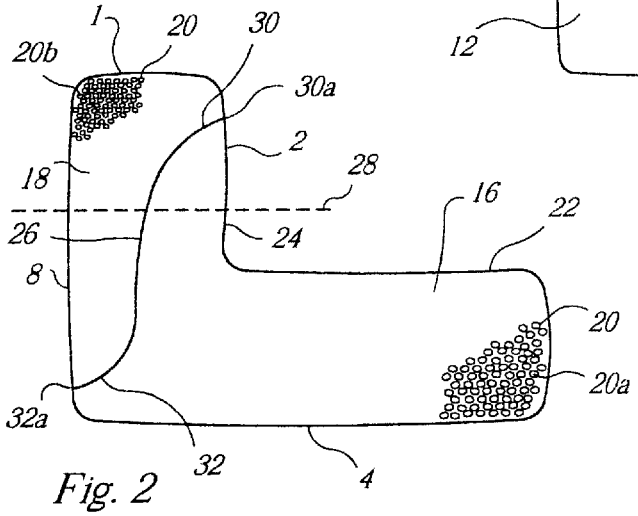
FIG. 2 is a cross-sectional view of the chair of FIG. 1, taken along line 2—2.

FIG. 2 is a cross sectional view of a chair in accordance with the present invention. The chair includes the flexible enclosure 1 having a first compartment 16, a second compartment 18 and a freely-flowable filler 20 disposed within the first compartment 16 and the second compartment 18. In FIG. 2, circles are used to depict the freely-flowable filler 20 and are not drawn to scale, and they do not represent actual quantities of freely-flowable filler used to fill the compartments 16 and 18. The first compartment 16 defines a seating surface 22 and the second compartment 18 defines a back rest 24.

The first compartment 16 and the second compartment 18 each include a defined distribution density of freely-flowable filler 20, wherein the defined distribution density in the first compartment 16 is different than the defined distribution density in the second compartment 18. The defined distribution density, as used herein, refers to the physical quantity of freely-flowable filler used to fill the compartments 16 and 18 in a given volume. In one embodiment the defined distribution density of freely-flowable filler 20 is greater in the second compartment 18 than in the first compartment 16.

In addition or alternatively, the freely-flowable material 20 is made of a first material 20*a* having a first material density and a second material 20*b* having a second material density, wherein the first material 20*a* is disposed in the first compartment 16 and the second material 20*b* is disposed in the second compartment 18. In an exemplary embodiment, the material density of the first material 20*a* is greater than the material density of the second material 20*b*. The "material density," as used herein, refers to the specific density of the individual components that make up the freely-flowable filler.

Thus, the combination of "distribution density" and "material density" provide for an "overall density." There are several ways to provide selected overall density values of the compartments 16 and 18 to obtain a higher overall density in the second compartment 18 compared to the first compartment 16. For example, the second compartment 18 may be filled with a freely-flowable filler 20 having: ( a ) a low material density and being filled to a high distribution density; ( b ) a high material density and being filled to a low distribution density; or ( c ) a high material density and being filled to a high distribution density. Further, the first compartment 16 may be filled with a freely-flowable filler 20 having: ( a ) a low material density and being filled to a low distribution density; ( b ) a high material density and being filled to a low distribution density; or ( c ) a low material density and being filled to a high distribution. The objective is to provide a higher relative density in the second compartment 18 than in the first compartment 16.

The freely-flowable filler may be manufactured from all variety of materials. In the exemplary embodiment plastic or polystyrene beads or the like are used. It should be understood that the freely-flowable filler 20 will in most cases fill the entire compartment and that individual components of the freely-flowable filler will most likely touch one another. Further, it should be understood that the individual components of the freely-flowable filler 20 can be of any shape or size.

In an exemplary embodiment, of the present invention, the chair may include a dividing member 26 disposed within the enclosure 1 that separates the first compartment 16 from the second compartment 18. The top portion 2, and the bottom portion 4 have a midline 28 between them. The dividing member 26 includes a first end portion 30 and a second end portion 32, wherein the first end portion 30 of the dividing member 26 is secured to the enclosure 1 at a point 30*a* within the top portion 2, and the second end portion 32 of the dividing member 26 is secured to the enclosure 1 at a point 32*a* within the bottom portion 4. Point 30*a* is at a position that is relatively above midline 28, whereas, point 32*a* is at a position that is relatively below midline 28. The bottom portion 4 extends away from the top portion 2 to define front 6 and back 8 chair portions, wherein the first end portion 30 of the dividing member 26 is secured to the front portion 6 of the top portion 2, and the second end portion 32 of the dividing member 26 is secured to the back portion 8 of the bottom portion 4. The flexible enclosure 1 may be constructed of any flexible material. The enclosure 1 of the exemplary embodiment is manufactured from cotton, polyester or a like material. The dividing member 26 may be constructed of a material that is non-resilient or less flexible relative to the material that the enclosure 1 is manufactured from.

Figure 3:
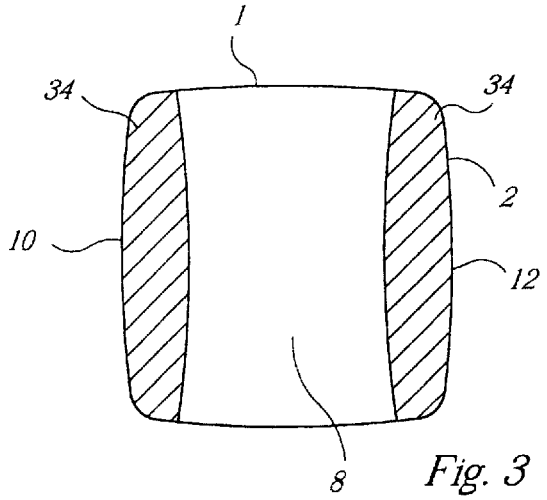
FIG. 3 is a cross-sectional view of the back portion of the chair of FIG. 1, taken along line 3—3.

FIG. 3 is a cross-sectional view of the back of the chair. The top portion 2 has a left side 10, a right side 12, and includes foam 34 disposed within the enclosure 1 along the left 10 and right 12 sides, wherein foam 34 has less flexibility than the enclosure 1.

It will be appreciated by persons skilled in the art that the present invention is not limited to what has been particularly shown and described herein above. A variety of modifications and variations are possible in light of the above teachings, that will not involve undue experimentation and without departing from the scope and spirit of the invention, which is limited only by the following claims.

What is claimed is:

1. A chair, comprising:

a flexible enclosure having a first compartment and a second compartment; and a freely-flowable filler disposed within the first compartment and the second compartment;

a dividing member disposed within the enclosure that defines the first compartment from the second compartment, wherein the enclosure defines a top portion, a bottom portion, and a midline between the top and bottom portions, wherein the dividing member includes a first end and a second end, wherein the first end of the dividing member is secured to the enclosure at a point within the top portion, and wherein the second end of the dividing member is secured to the enclosure at a point within the bottom portion, wherein the bottom portion extends away from the top portion to define front and back chair portions, wherein the first end of the dividing member is secured to the front portion of the top portion, and wherein the second end of the dividing member is secured to the back portion of the bottom portion, wherein the dividing member is non-resilient.

2. A chair, comprising:

a flexible enclosure having a first compartment and a second compartment; and a freely-flowable filler disposed within the first compartment and the second compartment;

a dividing member disposed within the enclosure that defines the first compartment from the second compartment, wherein the enclosure defines a top portion, a bottom portion, and a midline between the top and bottom portions, wherein the dividing member includes a first end and a second end, wherein the first end of the dividing member is secured to the enclosure at a point within the top portion, and wherein the second end of the dividing member is secured to the enclosure at a point within the bottom portion, wherein the top portion has a left side and a right side, and further including foam having less flexibility than the enclosure and wherein the foam is disposed within the enclosure along the left and right sides.

* * * * *